United States Patent [19]

Kreinberg et al.

[11] Patent Number: 4,789,352

[45] Date of Patent: Dec. 6, 1988

[54] POWER CONNECTOR HAVING LINEARLY MOVING CAM FOR DAUGHTER CARD

[75] Inventors: Earl R. Kreinberg, Phoenix; Paul Vinson, Carefree, both of Ariz.

[73] Assignee: AMP Incorporated, Harrisburg, Pa.

[21] Appl. No.: 127,748

[22] Filed: Dec. 2, 1987

[51] Int. Cl.[4] ..... H01R 13/62

[52] U.S. Cl. ..... 439/260; 439/157

[58] Field of Search ..... 439/260–265, 439/266–270, 55, 59–61, 157

[56] References Cited

U.S. PATENT DOCUMENTS

| | | | |
|---|---|---|---|
| 3,576,515 | 4/1971 | Frantz | 439/267 |
| 3,963,317 | 6/1976 | Eigenbrode et al. | 439/267 |
| 4,077,688 | 3/1978 | Cobaugh et al. | 439/267 |
| 4,133,592 | 1/1979 | Cobaugh et al. | 439/260 |
| 4,390,224 | 1/1983 | Showman et al. | 439/260 |
| 4,392,705 | 7/1983 | Andrews, Jr. et al. | 439/259 |
| 4,428,635 | 1/1984 | Hamsher, Jr. et al. | 439/260 |
| 4,451,818 | 5/1984 | Grabbe et al. | 439/296 |
| 4,480,884 | 11/1984 | Babuka et al. | 439/260 |
| 4,517,625 | 5/1985 | Frink et al. | 439/266 |
| 4,636,021 | 1/1987 | Bobb et al. | 439/260 |
| 4,648,668 | 3/1987 | Sinisi | 439/267 |
| 4,682,834 | 7/1987 | Dunn et al. | 439/260 |

OTHER PUBLICATIONS

AMP Catalog No. 76-376, "AMP ZIF (Zero Insertion Force) Printed Circuit Board Connectors", 2-1980; AMP Incorporated, Harrisburg, PA.

AMP DAta Sheet No. 76-376, 10-1976 "Printed Circuit Panels and Components"; pp. 15-20 and 15-21, AMP Incorporated, Harrisburg, PA .

AMP Publication, "Intercard Connection Without Backplanes", R. Cobaugh and A. Taylor, 5-1977, pp. 2-3; AMP Incorporated, Harrisburg, PA.

*Primary Examiner*—Neil Abrams

*Attorney, Agent, or Firm*—Anton P. Ness

[57] ABSTRACT

A power connector for distributing power current to an active edge of a daughter card which is insertable into a channel of the power connector, includes a plurality of terminals electrically connected to a power source. A rectilinear cam shaft within a longitudinal aperture of the connector housing is movable linearly upon actuation to deflect cantilever beam portions of the terminals into the card-receiving channel to engage contact sections of the daughter card along the active edge and power the card. The cantilever beams extend at an angle through transverse angled profiled apertures of the cam shaft to free ends along the channel bottom and are cammed into the channel and against card contacts by being engaged by first camming wall surfaces of the profiled aperture upon actuation. The beams may also be similarly cammed out of card contact engagement by opposed second camming wall surfaces of the profiled aperture engaging the beams when the cam shaft is moved linearly in the opposite direction to disengage from the card's contact sections and clear the channel allowing withdrawal of the card from the channel. An actuator which is rotatable at a front end of the connector has a helical groove segment into which is held a boss of a follower contained in the front of the cam shaft, translating the actuator's rotary motion into linear motion.

9 Claims, 10 Drawing Sheets

304
302
314A
306
316
312
310
318'
324
328
330
322
B
320
326
300
314B
262
260
160
162
A
161
308

POWER CONNECTOR HAVING LINEARLY MOVING CAM FOR DAUGHTER CARD

FIELD OF THE INVENTION

The present invention is related to the field of electrical connectors, and more particularly to connectors for edge portions of circuit panels.

BACKGROUND OF THE INVENTION

Card cages are known which comprise a framework within which a plurality of circuit panels or daughter cards are insertable, and within which is disposed a backplane transverse to the back edges of the daughter cards. The cards are electrically connected to the backplane by any of several types of known connectors and terminals, and are interconnected by the backplane to each other and to other electrical components on the opposite side of the backplane. Each daughter card in conventional card cages also receives all necessary power current for its components from the backplane through a plurality of terminals, each capable of transmitting power current at levels ordinarily about one ampere per terminal. Connectors which must house the quite numerous power-carrying terminals also must house signal terminals for the primary purpose of providing signal transmission to and from the daughter cards; signal terminals are thus limited in number and in their position, which in turn limits the capabilities of the daughter cards. Also, the current levels presently available limit the number and types of components usable with the daughter cards.

Another feature of conventional card cages is that the power current is provided to the backplane from power conductor cables from outside the card cage, and the transmission of power into the card cage is usually controlled by one switch. In such card cages transmission of power to the individual daughter cards is not controlled on a card-by-card basis and in fact power current to all the cards is either all ON or all OFF. Therefore, power to all cards must be turned off to permit insertion or removal of an individual daughter card, resulting in undesirable levels of down time.

Multilayering of daughter cards is presently done to transmit power current received along the back edge by numerous power terminals, to interior regions of the daughter card in order to avoid interfering with the increasing number and the positioning of signal circuit paths desired, in an effort to enhance the capabilities of daughter cards, given the limitation of back edge power reception in present day card cages. Multilayering of daughter cards, as with multilayering of backplanes, is costly.

It would be desirable to provide power current to daughter cards distributed along edge surfaces other than the back edge, without interfering with the ability of the daughter card to be easily inserted and withdrawn from the card cage.

It would be desirable to provide power current at levels higher than is presently available to individual power paths of the daughter card, and to provide a higher total power current to the card.

It would further be desirable to provide power current to each daughter card individually, and to shut off power current individually, to minimize down time of the entire card cage.

It would additionally be desirable to provide a means for assuring that the provision of power current to an individual daughter card occurs only after the card has been fully inserted into its proper seated position within the card cage and locked therein, to prevent substantial damage and destruction to a card or its components such as integrated circuit packages, by premature powering.

It would yet be desirable to provide a connector and corresponding card edge construction for providing power current distributed therealong by individual power current conductor means connected to a power supply, to allow for repair or replacement of the power conductor means and also to allow for different selected current levels at specific locations along the edge of the daughter card.

Also, it would be desirable to provide a card cage with power connectors mounted therein as an assembly, to be electrically connected later as desired with respective daughter cards from various sources of manufacture, and various thicknesses and various configurations of circuit paths for conducting power current to the interior regions of the card's surface.

Additionally, it would be desirable to provide an array of power connectors in a card cage for respective daughter cards, in a manner which does not inhibit or complicate the procedure for the insertion or withdrawal of the daughter card from the cage.

SUMMARY OF THE INVENTION

The present invention is an electrical connector for distributing power current to a side edge of a daughter card inserted into a card cage, where the power connector is mounted to framework of the card cage, such as opposite another like connector. Each power connector has a channel, and each daughter card is insertable into the card cage along opposed channels of the opposed connectors. Contact sections along the side edge of the daughter card are portions of power bus paths extending into the interior regions of the side surfaces of the card to electrical components to be powered. Individual terminals in the power connector correspond to the card contact sections and contact ends on cantilever beams thereof are disposed along the channel bottom to be cammed into electrical engagement with the card contact sections by a camming system of the power connector. A linearly movable cam shaft includes respective profiled angled apertures therethrough through which the cantilever beams of the terminals extend. Surfaces of the forwardly and rearwardly facing aperture walls engage sides of the cantilever beams to deflect their free ends downward into the channel during actuation to engage daughter card contacts, and to deflect them out of the channel to disengage and clear the channel for card withdrawal. A rotatable actuator is also provided, with a helical groove segment along its shaft within which is held a boss of a follower held in the cam shaft; the actuator moves the follower which translates rotary motion into linear motion.

According to another aspect of the present invention, the daughter cards include a mechanism for securing the card in position after full insertion into the card cage, which is adapted to cooperate with the cam's actuator of the power connector to prevent the actuator from being actuated whenever the card is not secured in place. A portion of the actuator must follow a path which intersects a path of a portion of the mechanism so that when the portion of the mechanism is not in a secured position, it interferes with and obstructs the path which the actuator portion must follow during actuation. Conversely, the actuator in its actuated position obstructs the path which must be followed by the portion of the mechanism to unlock and eject the daughter card from the card cage. Also, the actuator may be disposed across the open end of the card-receiving channel in its actuated position, preventing insertion of a card thereinto until the actuator is moved to the deactuated position, thus assuring that the terminal cantilever ends have been moved out of the channel.

It is an objective of the present invention to provide a connector system for distributing power current along a side edge of a daughter card.

It is also an objective to provide power current to each daughter card independently of the powering of the other daughter cards in the card cage, and conversely to independently shut off power current to the card, thus performing a switching function.

It is a further objective to provide such a connector which enables insertion and withdrawal of a card freely from the card cage.

It is another objective to provide a means of assuring that a daughter card is locked in its fully inserted position before any power current is able to be provided to any portion of the card, and to assure that all power current is shut off to the card before it can be unlocked and removed from the card cage.

It is yet another objective of the present invention to provide a connector which can provide power current of the range of about ten amperes or more to individual contact sections of a daughter card within a card cage.

DETAILED DESCRIPTION OF THE PREFERRED EMBODIMENT

Figure 1:
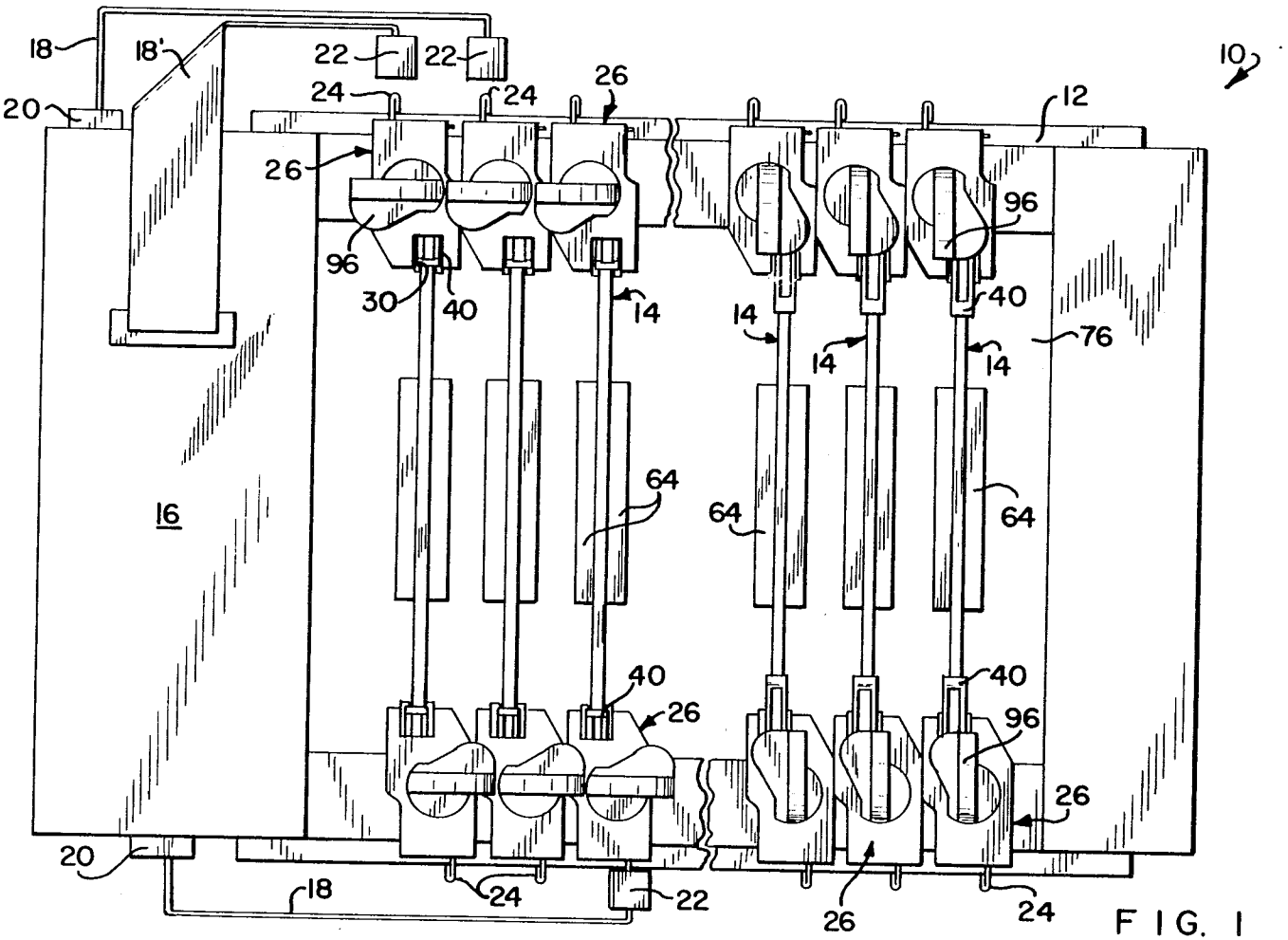
FIG. 1 is an elevation view of a card cage having a plurality of circuit cards therein of the present invention, each disposed between and mated with a pair of edge guide power connectors of the present invention connected to a power source, with the cards on the right being locked in place and the power connectors actuated.

FIG. 1 shows a card cage 10 including a frame 12 having a plurality of representative daughter circuit cards 14 inserted thereinto from the open front, and which may be removed therefrom. Cards 14 receive power current for electrical components 64 mounted thereon from a power supply 16 also insertable into and removable from the card cage, by means of a plurality of power cables 18. Each cable 18 is electrically connected by first terminal means 20 to corresponding terminal means (not shown) of the power supply, and is terminated by second terminal means 22 for electrical engagement with one or more of a plurality of terminals 24 spaced along an edge guide power connector 26 corresponding to an active edge of a daughter card 14. At least one return path conductor 18' is also provided and connected to the power supply 16. Preferably the plurality of edge guide power connectors 26 are secured to the card cage frame 12 in spaced parallel arrays along the top and bottom of the card-receiving area of the card cage. Such a card cage system is disclosed in more particularity in U.S. patent application Ser. Nos. 128,000 and 127,992 filed Dec. 2, 1987 and assigned to the assignee hereof. A flexible power distribution system particularly useful with such a card cage system is described in greater particularity in U.S. patent application Ser. No. 50,793 filed June 22, 1987 and assigned to the assignee hereof, although conventional power conductor wires may be used.

Figure 2:
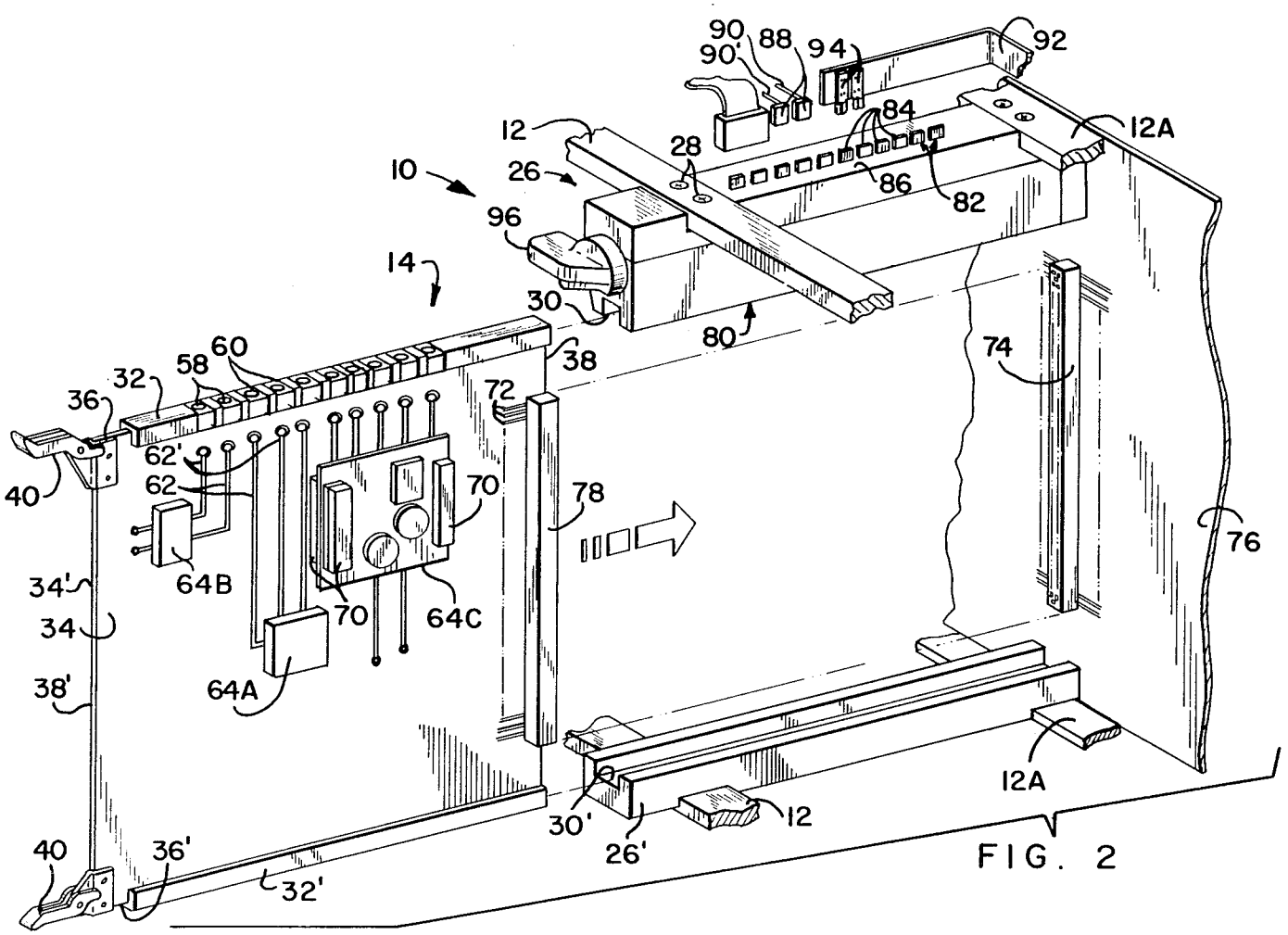
FIG. 2 is a perspective view of a daughter card exploded from its position in the card cage of FIG. 1 and from between an edge guide power connector of the present invention and an opposing channel member.

Referring to FIG. 2, edge guide power connector 26 is mounted to card cage frame 12,12A such as by pairs of fasteners 28 at each end of the connector. Each power connector 26 includes a card-receiving channel 30 within which is disposed a rail 32 secured to an active edge of a daughter circuit card 14. Channel 30 preferably has rectilinear side wall and bottom surfaces, and rail 32 correspondingly preferably has rectilinear top and side surfaces, which surfaces will undergo at least incidental bearing engagement during insertion and withdrawal of card 14 into and out of the card cage. Preferably the front end of channel 30 and the rearward end of rail 32 include tapered corners for lead-in purposes facilitating insertion.

Each daughter card has two major side surfaces 34,34', top and bottom edges 36,36', and back and forward edges 38,38'. In a typical card cage 10 top and bottom edges 36,36' of each daughter card 14 may be active edges, and each active edge will have a respective rail 32 so that card 14 can be inserted into the card cage frame from a card-receiving face thereof within aligned and opposing channels 30 of a pair of opposed power connectors 26. However, it is foreseeable that one or more daughter cards 14 may only have one active edge for the receipt of power current and with such a card the edge opposed from the active edge preferably will still have a rail such as rail 32' and be received along a channel 30 of an inactive power connector or dummy member 26' having a card-receiving channel 30', or even a channel of the card cage frame 12 itself.

Figure 2A:
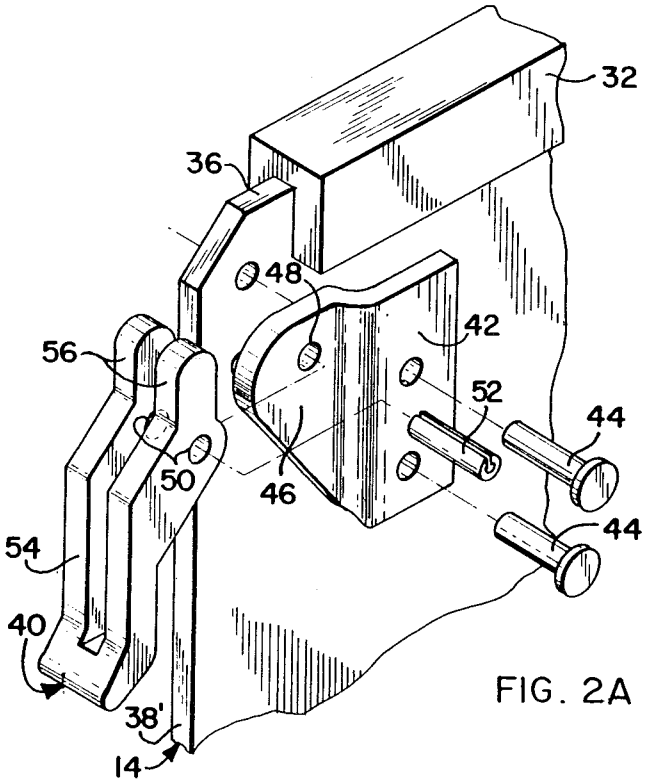
FIG. 2A is an enlarged exploded view of one of the insertion/ejection members of the daughter card of FIG. 2.

Each daughter card 14, once fully inserted into opposed channels 30,30 (or 30,30') therefor, is then secured therein by insertion/ejection members 40 (FIG. 2A) which have securing means cooperable with corresponding locking means of the power connectors 26 (or of the dummy connector 26'). Securing members which also serve to eject the daughter card partially from the card cage are conventionally known. In FIG. 2A insertion/ejection member 40 is pivotably securable to card 14. Mounting plate 42 is fastened to a corner of card 14 along top edge 36 at front edge 38' using rivets 44, for example. Flange 46 includes a pivot hole 48, and pivot holes 50 of bifurcated insertion/ejection member 40 are aligned therewith on both sides, after which roll pin 52 is inserted through holes 50,48,50. Pin 52 enables pivoting of hand-grippable portion 54 between a locked position as shown and an unlocked position wherein hand-grippable portion 54 extends perpendicularly outwardly from front edge 38'. Locking protrusions 56 will enter a corresponding cavity of power connector 26 in order to lock, after full insertion of card 14 into the card cage.

Figure 3:
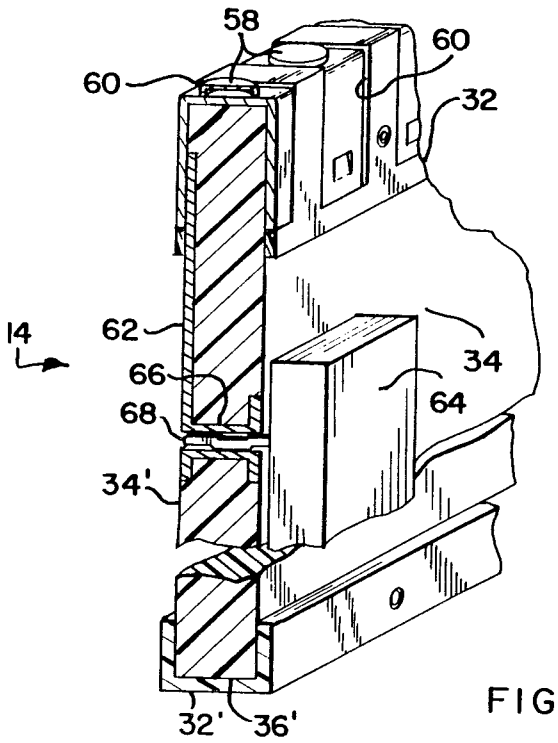
FIG. 3 is an enlarged part section view of a daughter card of FIG. 2 showing a power circuit path extending to a component mounted on the opposite side of the card.

After card 14 is locked in position an actuator 96 of connector 26 is moved to an actuating position, which cams the plurality of terminals into electrical engagement with corresponding contact means 58 of the daughter card exposed in recesses 60 of rail 32 shown in FIG. 3. For appropriate electrical engagement to conduct the levels of power current being transmitted to daughter card 14 such as ten amperes or greater at each contact location for long in-service use, contact means 58 preferably comprise buttons of low resistance silver or silver alloy fastened such as by soldering or by inlaying onto circuit paths 62 which extend to terminals (such as pin terminals 68 shown in FIG. 3) of components 64 to be powered, or they may be end portions of circuit paths 62 themselves. Corresponding return paths 62, extend back to the active edge of daughter card 14 to be similarly connected to a return path conductor 18'. Alternatively return paths 62' may be commoned to one return path on the daughter card with one contact section along the active edge for electrical connection to one return path conductor via one return terminal of the power connector.

As seen in FIG. 3, components 64 can be mounted on either major side surface 34 or 34' of card 14, irrespective of which side surface circuit paths 62 are disposed along, through the use of conductive plated through-holes 66 electrically connected to the circuit paths and of component terminals such as those with pin sections 68 having compliant sections adapted to self-secure within plated through-holes in electrical engagement therewith after being inserted therein, both of which are conventionally known and may be used. Because of such capability, it is possible and preferable to place contact sections 58 along a common side of the active edge which simplifies the construction of edge guide power connectors 26. It is also possible to place power circuit paths 62 on one major side surface such as 34', allowing the other major side surface 34 to be devoted to signal circuit paths such as signal paths 72 along back edge 38.

Components 64 foreseeably usable with circuit panels 14 in a card cage can be, for instance, integrated circuit packages 64A, transistors, solid state components, and also LEDs such as LED 64B placed near front edge 38' for visual indication of a POWER ON state of the daughter card. As is disclosed in Ser. No. 128,000 smaller circuit cards or baby boards 64C can be in turn mounted onto the daughter card and have components to be powered by the card, with electrical engagement established using, for example, stacking connectors 70 such as AMP HDI connectors sold by AMP Incorporated, Harrisburg, Pennsylvania.

Upon actuation of edge guide power connector 26, daughter card 14 and its components 64 will be powered. With power current being brought to the card from the top edge 36 or both the top and bottom edges 36,36', back edge 38 of the card with its premium real estate can be devoted to the electrical connection of signal paths 72 of the card to corresponding contact means of connectors 74 mounted on backplane 76 of card cage 10, upon full insertion of card 14 in the card cage. Backplane 76 is also a circuit panel as are daughter cards 14 and is secured to the framework of the card cage to be orthogonally disposed adjacent and transverse with respect to back edges 38 of all the daughter cards 14 inserted into the card cage. Connectors 74 mounted on backplane 76 have terminals electrically connected to respective circuit paths of the backplane which interconnect corresponding contacts of connectors 78 such as AMP HDI connectors, of the various daughter cards mounted on back edges 38 thereof. A rearward frame portion 12A can abut backplane 76 to precisely locate power connector 26 such that the mating pair of signal connectors 78,74 have just enough clearance to mate properly when card 14 is locked in position. Frame 12A can also assure that rearward end of power connector 26 is aligned with respect to connector 74 that its card-receiving channel brings back edge 38 of card 14 and connector 78 into precise alignment with connector 74 upon insertion.

Backplane 76 can also have pin or post arrays (not shown) to permit conventional wire wrapping to achieve electrical interconnection. Backplane 76 can also provide for electrical connection of terminals of connectors 78 with corresponding contact means of components or other circuit boards (not shown) mounted in card cage 10 behind backplane 76, such as is conventionally known. With the backplane freed of the duty of transmitting power to the daughter cards as has been conventional, and providing for signal transmission to and from the daughter cards for communication therebetween, much greater card cage utility is provided than has been known prior to the present invention.

Also shown in FIG. 2 edge guide power connector 26 comprises a dielectric housing assembly 80 including channel 30 into which rail 32 along an active edge of the daughter card will be inserted. Housing assembly 80 also includes a plurality of terminals 82 firmly mounted therewithin along the top portion and having a first contact section 84 for electrical connection to a terminal means of a power cable means connected to power supply 16. Preferably first contact section 84 is blade-like and extends from top surface or cable face 86 of housing assembly 80 to be engaged by a corresponding receptacle terminal secured to a power conductor electrically connected to power supply 16, as shown in FIG. 1.

Each edge guide power connector 26 has an actuator 96 which is actuatable to power the associated daughter card independently of the other daughter cards in the card cage, and as such represents a singular major advance in card cages. Also each power connector 26 can be independently deactuated to permit removal of its daughter card for repair or replacement, while all other cards remain fully powered and functioning.

Terminals 88 connected to conventional power and return conductors 90,90' can be for instance the fully insulated receptacle type sold under the trade designation Ultra-Fast FASTON by AMP Incorporated, Harrisburg, Pennsylvania. A preferred power conductor is a flexible flat power cable 92, such as the cable disclosed in U.S. patent application Ser. No. 50,793, using for example terminals 94 which are terminatable to flat conductor cable in a manner similar to that utilized by terminals sold under the trademark TERMI-FOIL by AMP Incorporated, and using an appropriate blade-matable receptacle structure similar to the FASTON terminals. The power conductor terminals may preferably be removable from first contact sections 84 enabling repair or replacement of a terminal or of the power cable. Each terminal 82 of the edge guide power connector further includes a cantilever portion extending therefrom to a free end on which is disposed a second contact section (FIG. 10) which is cammed into electrical engagement with a contact means 58 of the daughter card by a camming means extending through housing assembly 80, upon actuation thereof by rotary movement of actuator 96.

Figure 4:
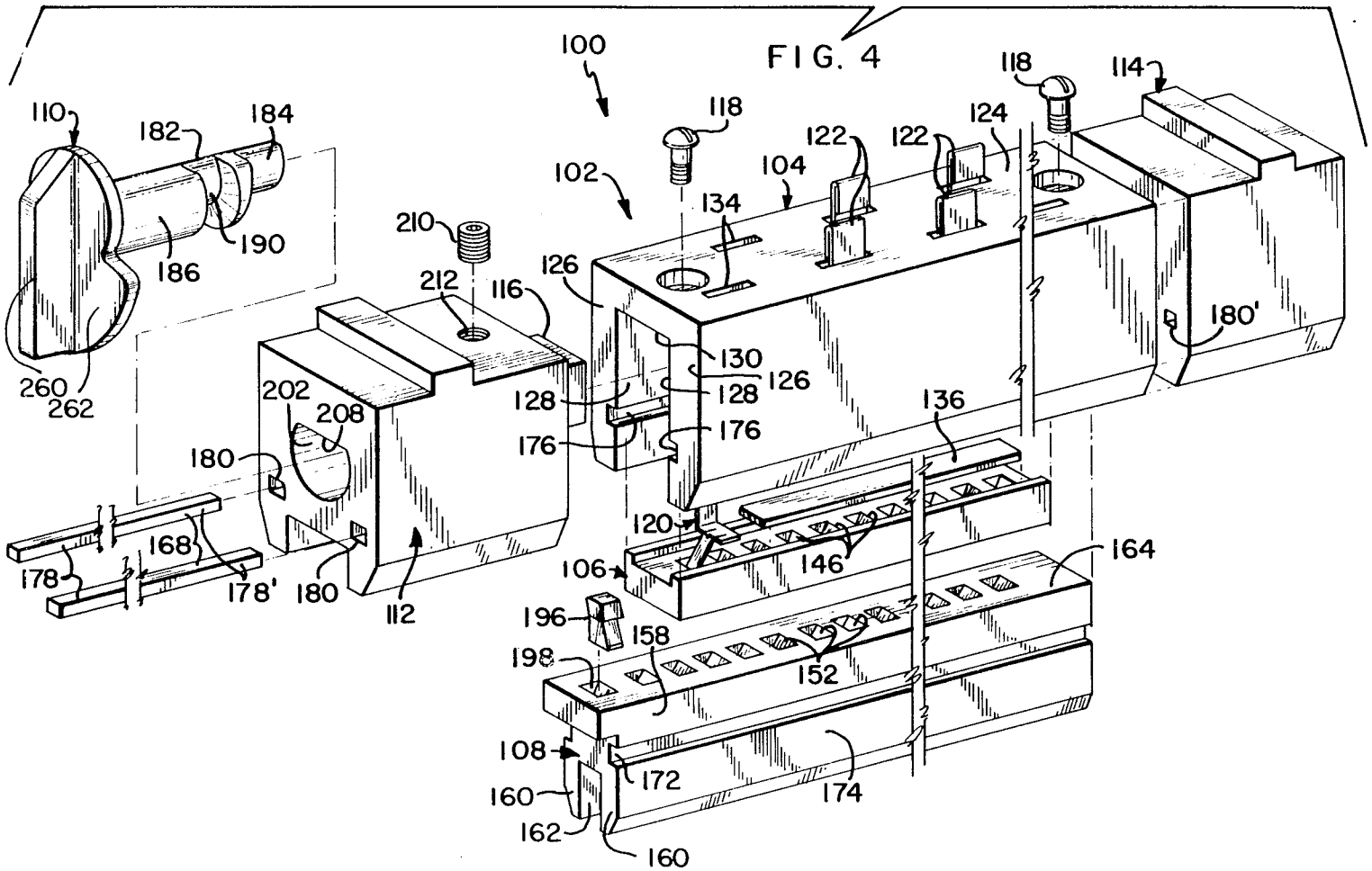
FIG. 4 is an exploded perspective view of the edge guide power connector having a linearly movable cam shaft and showing the actuator, housing, a terminal, and retention rails along which the cam shaft is moved.
Figure 5:
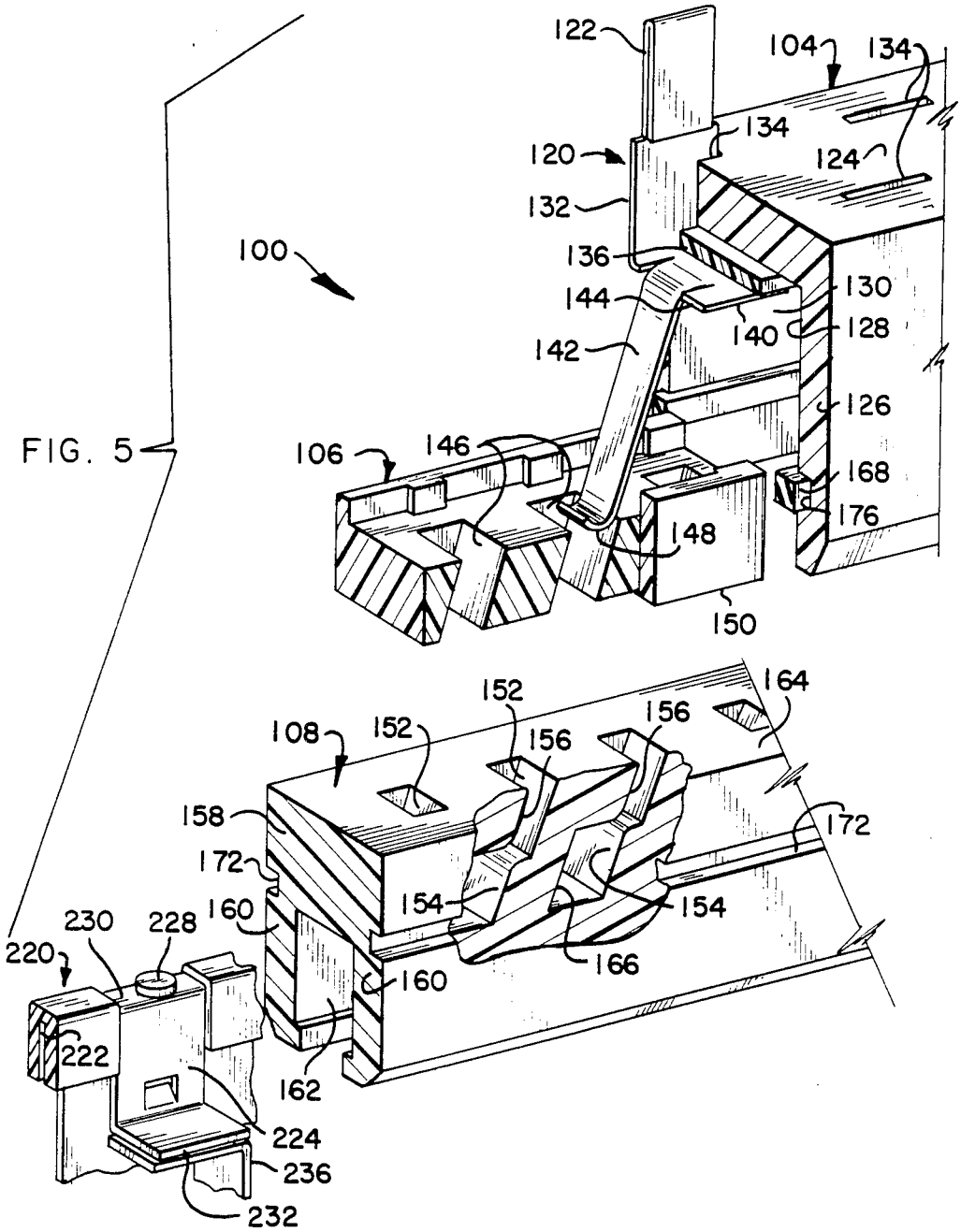
FIG. 5 is an enlarged exploded, part cross section of the power connector of FIG. 4 showing a terminal and its housing and cam shaft apertures, with a card edge section exploded from the channel.
Figure 6:
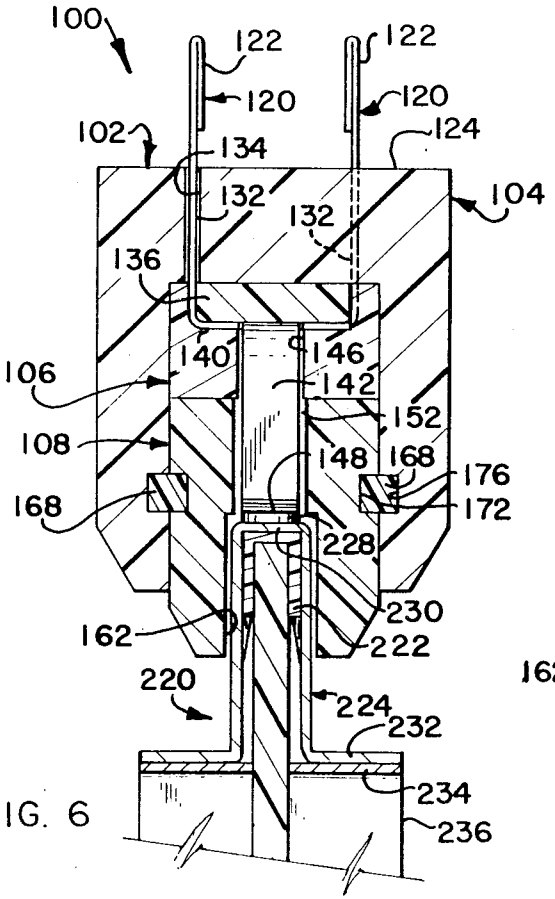
FIG. 6 is a cross-sectional view of the daughter card in the channel of the power connector of FIG. 4 and a terminal engaged with a card contact section.

FIGS. 4 to 10 illustrate edge guide power connector 100 having a linear motion cam shaft. Connector 100 includes a housing assembly 102 including a first or upper housing member 104, a second or middle housing member 106, cam shaft or member 108 comprising the bottom portion of housing assembly 102, actuator 110 secured a forward housing member 112, and rearward housing member 114. Forward housing member 112 includes a lug 116 insertable into a forward end of upper housing member 104, allowing securing to the upper housing member by a self-tapping screw 118 into a corresponding insert 118A in lug 116 (FIG. 6). Rearward housing member 114 is similarly securable to a rearward end of upper housing member 104. Connector 100 also includes a plurality of terminals 120 having respective first contact sections 122 extending upwardly from cable face 124 to be engageable by corresponding terminal means of power and return conductor means (FIG. 1) of the card cage. Upper housing member 104 includes a pair of depending flanges 126 having inwardly facing surfaces 128 forming cam-receiving channel 130, within which are disposed middle housing member 106 and cam shaft 108 upon assembly. Terminals 120 may have their first contact sections 122 disposed in two rows along cable face 124, if desired.

Referring to FIG. 5, vertical mounting section 132 of each terminal 120 extends through a vertical passageway 134 of upper housing member 104. An insert member 136 is disposed between lower surface 138 of upper housing member 104 and horizontal body section 140 of terminal 120, and middle housing member 106 holds horizontal body section 140 against insert 136. Spring arm 142 of terminal 120 extends downwardly from forward side edge 144 of horizontal body section 140 and forwardly at an angle through an angled opening 146 of middle housing member 106. Spring arm 142 extends to a free end 148 below lower surface 150 of middle housing member 106 into and through a corresponding angled opening 152 of cam shaft 108 defined by forwardly facing surface 154, rearwardly facing surface 156 and side surfaces. Cam shaft 108 has a body section 158 downwardly from both sides of which depend opposing spaced flanges 160 defining card-receiving channel 162. The front end of card-receiving channel 162 preferably has tapered corners comprising lead-in features facilitating insertion of a daughter card thereinto. Also, channel 161 of forward housing member 112 forwardly of channel 162 may have tapered corners for lead-ins. Each angled opening 152 extends from upper surface 164 of cam shaft 108 to channel 162 to be in communication therewith so that free end 148 can be deflected into channel 162 to engage a contact section of a corresponding terminal of the daughter card disposed along channel 162. Each angled opening 152 includes a recessed portion 166 in which arcuate-shaped free end 148 is disposed when not deflected into channel 162.

As shown in FIGS. 4 and 6, a pair of retention rails 168 provide a means for cam shaft 108 to be moved linearly with respect to the remainder of housing assembly 102, along lower surface 170 of middle housing member 106. Rails 168 are received along channels 172 on outer side wall surfaces 174 of body section 158 of cam shaft 108 paired with and facing opposed channels 176 along inwardly facing surfaces 128 of flanges 126 depending from upper housing member 104. Rail ends 178,178, are held in passageways 180,180' of forward and rearward housing members 112,114 respectively.

FIGS. 5 and 6 illustrate one embodiment 220 of daughter card the active edge of which includes a dielectric rail 222 secured thereto by periodically placed rivets (not shown) and including a plurality of terminal members 224 mounted in shallow recesses 226 therealong. Each terminal member can extend recessed along one or both side surfaces of rail 222 and recessed across the top surface, and includes a contact section 228 preferably a button of silver or silver alloy fastened along the terminal's top surface 230 such as by soldering, inlaying, or riveting. Contact section 228 is to be engaged by arcuate-shaped free end 148 of terminal 120 of power connector 100 when the power connector is actuated. Terminal 224 has at least one termination section 232 soldered or welded or clipped to a corresponding termination section 234 of a power bus member 236 of the card (FIG. 12), or alternatively electrically joined to a circuit path of the card (FIG. 3). Mounting of terminal 224 can be by a pair of locking lances 238 engaging stop surfaces 240 on both sides of rail 222.

Figure 7:
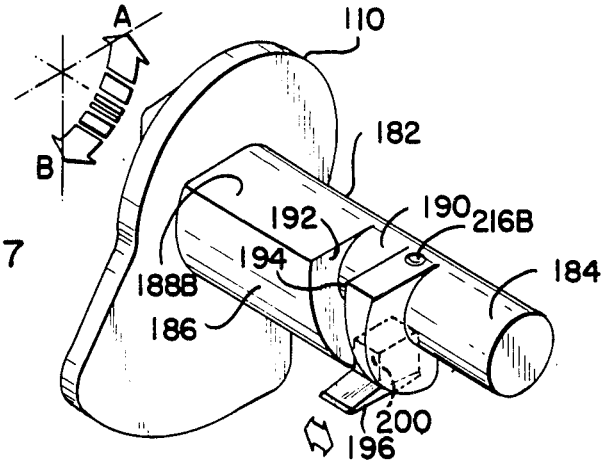
FIG. 7 is a rear perspective view of the rotary actuator of the power connector of FIG. 4, with a follower member in the actuator's helical groove.
Figure 9:
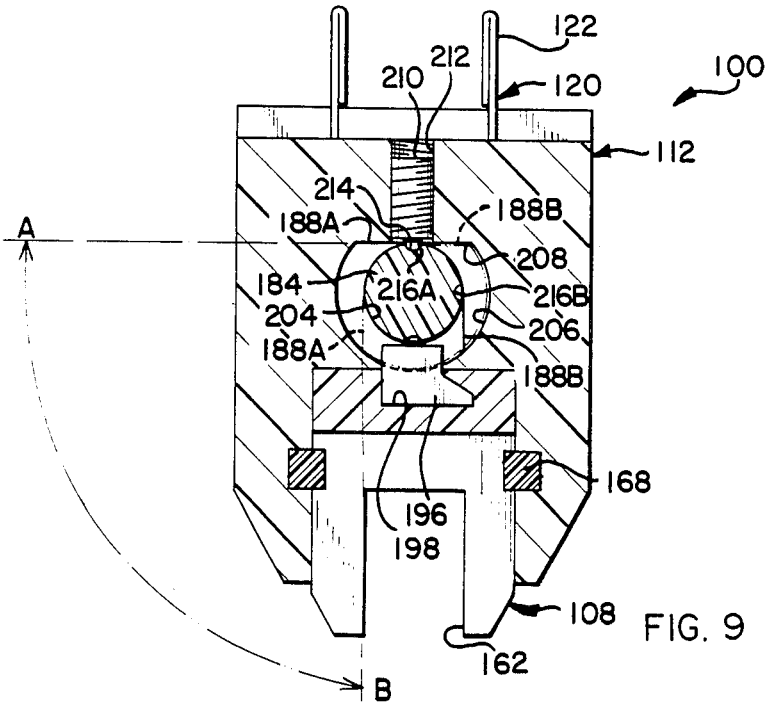
FIG. 9 is a cross sectional view through the forward end of the assembled connector of FIG. 4 showing the actuator in an unactuated position, with the actuated position in phantom, and the follower member in position.
Figure 8:
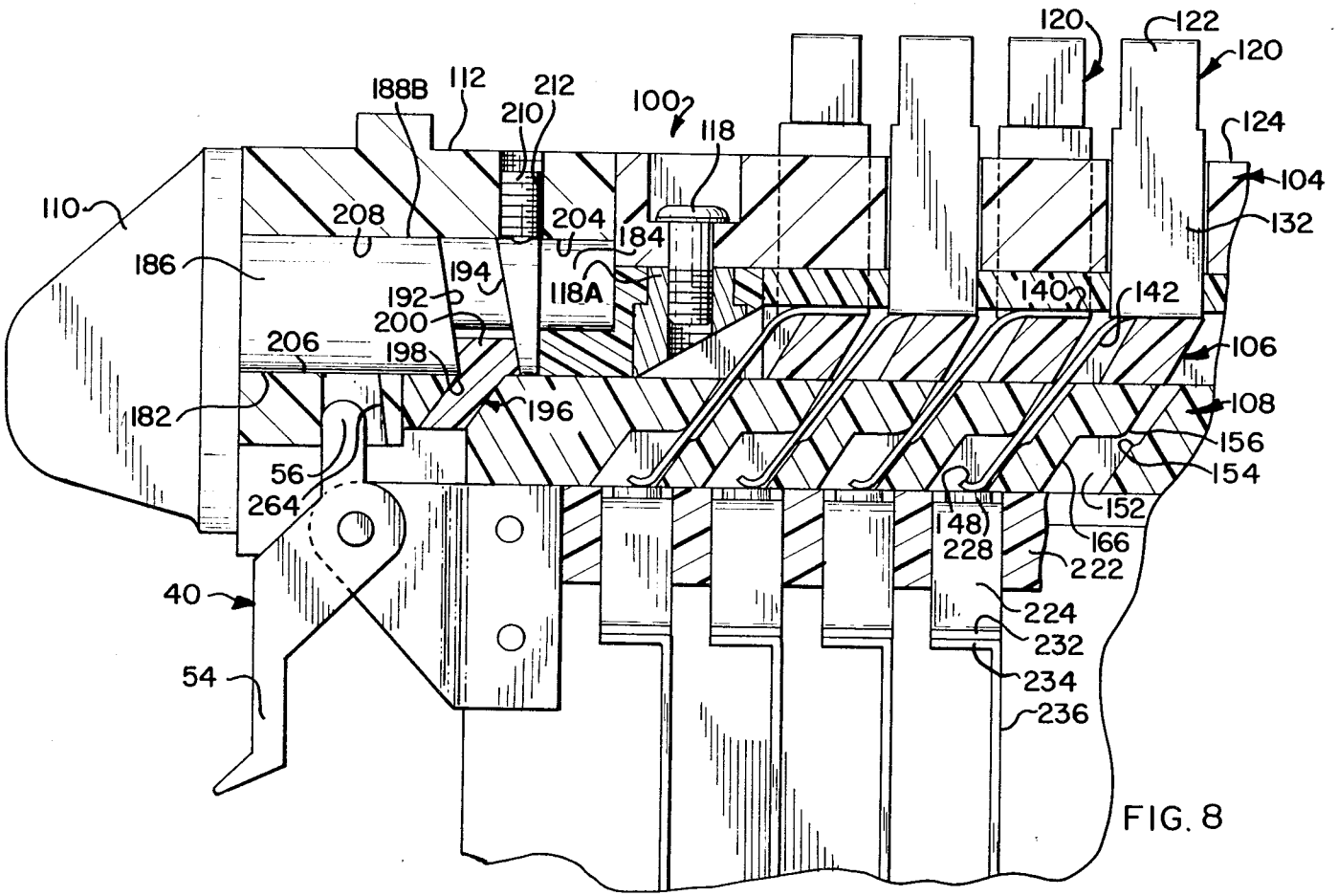
FIG. 8 is a part longitudinal section view of the power connector of FIG. 4 showing the relationship of the rotary actuator and the cam shaft, with a daughter card locked in position.

Actuator 110 as shown in FIGS. 7 and 8 includes a profiled shaft 182 having a smaller diameter end portion 184. Forward portion 186 has a cross section shaped generally like a quarter-cylinder with flattened side surfaces 188A,188B tangential with end portion 184 at the inner corner of the quarter-cylinder. Defined in forward shaft portion 186 is a helical groove segment 190 having opposed wall surfaces 192,194. Follower member 196 is disposed in cavity 198 at the forward end of cam shaft 108 along top surface 164 thereof, and includes a boss 200 extending upwardly into helical groove segment 190. Actuator 110 is secured to forward housing member 112 with its profiled shaft 182 within a profiled bore 202 of forward housing member 112. Profiled bore 202 includes a smaller diameter bore portion 204 associated with end portion 184 of actuator shaft 182, and a larger dimensioned profiled portion 206 associated with forward shaft portion 186 of actuator 110. Profiled bore portion 206 has a flat chordal surface 208 which gives it generally a semicylindrical shape and which serves as a stop defining unactuated position A and actuated position B for actuator 110 as shown in FIG. 9, when engaged by flattened surfaces 188A,188B of forward shaft portion 186 as actuator 110 is rotated during actuation and deactuation of connector 100.

With follower member 196 held in cavity 198 of cam shaft 108, and boss 200 thereof disposed within helical groove segment 190, as actuator 110 is rotated from unactuated position A to actuated position B, rearwardly facing wall surface 192 bears against boss 200 and moving follower 196 and cam shaft 108 rearwardly and translating rotational movement into linear motion, until flattened shaft surface 188B abuts chordal surface 208 of profiled bore 202 of forward housing member 112. Conversely, as actuator 110 is moved to its unactuated position A, forwardly facing wall surface 194 of helical groove segment 190 bears against boss 200 moving follower member 196 and cam shaft 108 forwardly, until flattened shaft surface 188A abuts chordal surface 208. It may be desired to utilize a detent assembly 210 threadedly secured within hole 212 so that detent 214 can be received into a first cavity 216A corresponding to unactuated position A or a second cavity 216B corresponding to actuated position B to retain actuator 110 in the selected position.

Figure 10:
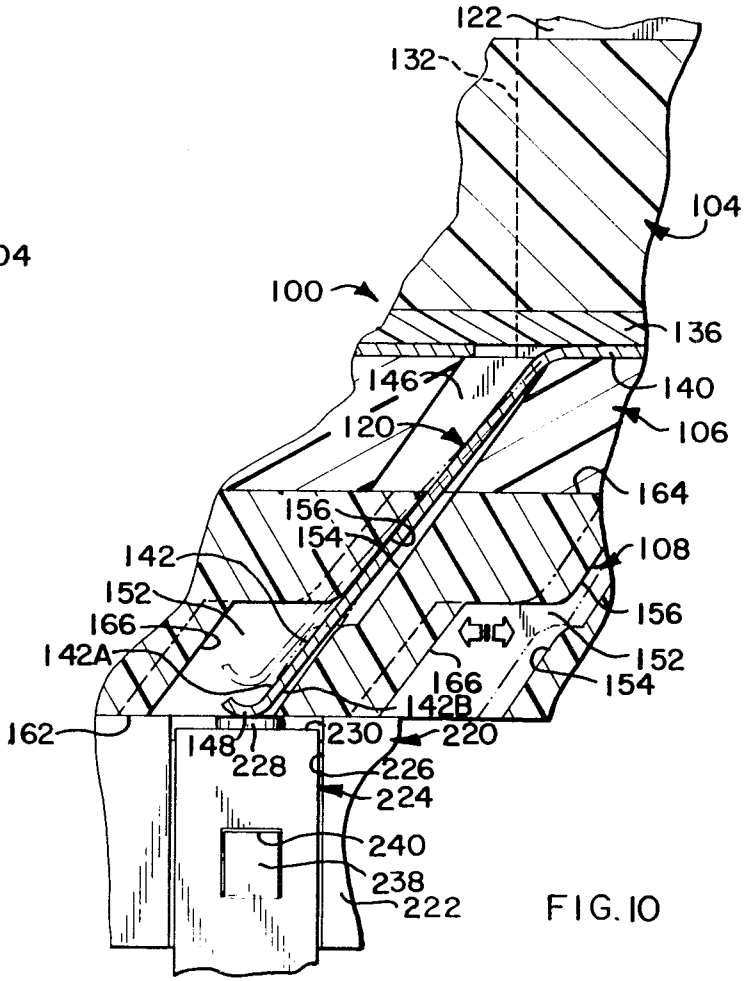
FIG. 10 is an enlarged longitudinal section view showing a terminal of the power connector of FIG. 4 cammed in an actuated position, and in a deactuated position (in phantom).

Referring to FIG. 10, when cam shaft 108 is moved rearwardly during actuation, rearwardly facing surface 156 of angled opening 152 of cam shaft 108 engages the front side 142A of spring arm 142 of terminal 120 and deflects it downwardly and rearwardly so that free end 148 is rotated into channel 162. Surface 156 holds free end 148 under tension against contact section 226 of daughter card 220 to establish a desired continuous contact normal force, which action incidentally creates a wiping action along the contact surfaces to break up oxides which typically form. When cam shaft 108 is moved to an unactuated position, forwardly facing surface 154 engages back side 142B of spring arm 142 and urges it forwardly and upwardly into recess 166 where it continuously holds it away from daughter card terminal 224 and clear of channel 162.

Terminals 120 can be stamped and formed of an appropriate low resistance, high copper content alloy, such as Copper Alloy No. C-197 sold by Olin Corporation. The housing members and cam shaft can be molded of, for example, material such as glass-filled thermoplastic polyester resin. It may be desired to modify connector 100 so that a selected terminals such as a return path terminal is the first to engage a corresponding daughter card contact section and the last to disengage therefrom. For instance, such a terminal can be formed longer so that the free end is closer to card-receiving channel 362 than the others in the unactuated position.

Close control over contact engagement and the application of contact normal force can be maintained, given the coupling of the edge guide power connector and the daughter card's active edge, by careful assembly of the power connector and by fabrication of the rail member so that contact surfaces of the contact sections along the side of the circuit panel are maintained a selected incremental distance from the level of the outer side surface of the rail. This can be accomplished by standardizing the thickness of the rail's flange along the contact section side, allowing the opposite flange to be varied in thickness according to the thickness of the particular circuit panel substrate with which the rail is to be used, which still maintains a standardized overall width to the rail member so that power connectors and their channels can be manufactured with common dimensions and still accommodate a variety of circuit panels.

In order to assure that power current is not transmitted to the active edge of the daughter card prior to the card being locked in position, it is preferred that a physical interference occur between insertion/ejection member 40 of the daughter card and the actuator of the power connector which prevents moving the actuator into its actuating position unless the insertion/ejection member is in its secured position. Actuator 110 includes a hand-grippable portion 260 and a transverse portion 262. Actuator 110 is in position A or the unactuated position with hand-grippable portion 260 disposed horizontally and extending toward the left of its connector 100. Position B or the actuated position is shown where the hand-grippable portion would be vertical or downward Hand-grippable lever portion 54 of insertion/ejection member 40 is in the unlocked or open state and extends out forwardly of the daughter card.

In order for actuator 110 to be rotated 90 degrees for actuation, transverse portion 262 would have to be moved in a path intersecting the position of lever portion 54 of insertion/ejection member 40 in its open state. Insertion/ejection member 40 has been moved to its locked state and lever portion 54 is now vertical along the front edge of daughter card 14 (FIG. 8), which provides clearance for transverse portion 262 so that actuator 110 can be moved to the actuated position. Locking protrusions 56 are shown in locking position within locking aperture 264 of power connector 100.

The interference system also requires that actuator 110 be positioned in its unactuated position in order for the daughter card to be either inserted into or withdrawn from the channel of the power connector, thus assuring that the free ends of the spring arms of all the terminals of the power connector are clear of the channel and disposed in the respective recesses. When actuator 110 is in the unactuated position, transverse portion 262 is disposed in front of the rail assembly of the daughter card and blocks insertion/ejection lever portion 54 from being rotated upwardly to unlock and eject the daughter card from the card cage.

Figures 11A, 11B:
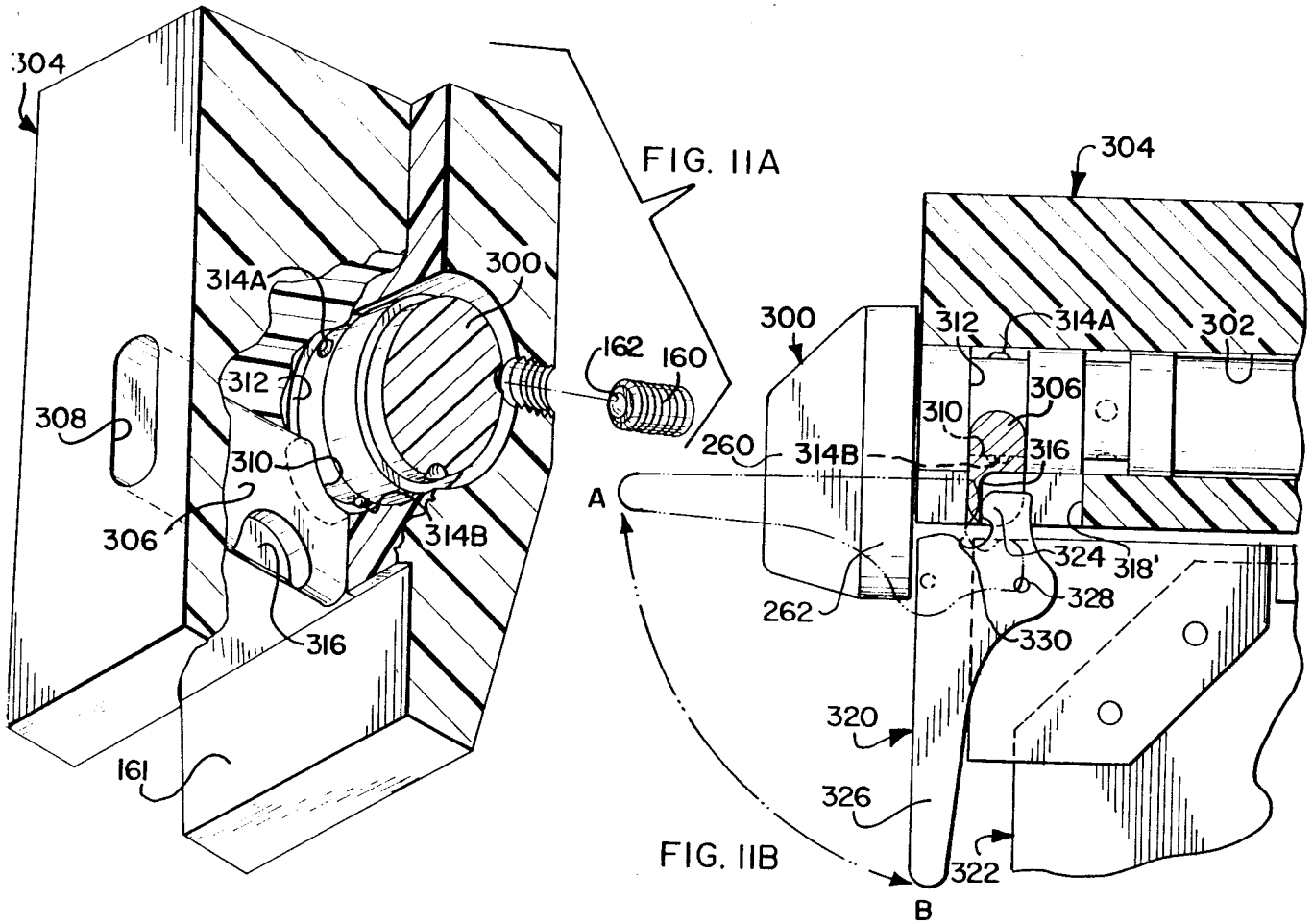
FIG. 11A is an enlarged part section view of another cam actuator and retention key therefor.
FIG. 11B is a part longitudinal section view showing another insertion/ejection member for use with the retention key of FIG. 11A, in the secured position, with the unsecured position shown in phantom.

As shown in FIGS. 11A and 11B, actuator member 300 may be secured in aperture 302 of forward housing member 304 by a key member 306 force-fitted into slot 308 of forward housing member 306 in communication with aperture 302. Corner 310 of key member 306 is inversely radiussed to fit within a corresponding annular recess 312 of actuator member 300 upon assembly, which restrains the actuator from axial movement along aperture 302, keeping it secured in the housing. Projections 314A,314B within annular recess 312 are positioned to abut sides of key member 306 when actuator member 300 has been rotated to either an unactuated position or an actuated position to prevent over-rotation.

Referring to FIG. 11B, a plate portion 316 of key member 306 depends relatively from key member 306 into a cavity 318 of forward housing member 304. Cavity 318 extends upwardly from the bottom surface of card-receiving channel 161 to communicate with slot 308 within which key member 306 is disposed. Plate portion 316 is positioned to be engaged by insertion/ejection member 320 after insertion of daughter card 322 into channel 161 in order to enable member 320 to secure card 322 in the card cage, and to enable member 320 to be manipulated to eject card 322 from the card cage for removal. Projection 324 of member 320 engages behind plate portion 316; as lever portion 326 is continued to be rotated downwardly about pivot 328 from position A to position B; projection 324 is relatively pushed rearwardly by plate portion 316 to urge card 322 completely into its fully inserted position. When it is desired to withdraw card 322 from the card cage, member 320 is rotated upwardly and anvil portion 330 engages the front surface of plate portion 316 and is pushed relatively forwardly to move card 322 slightly forwardly in ejection allowing card 322 then to be pulled completely out of the card cage. This insertion and ejection action serves to facilitate the mating and unmating of connectors 78 along the back edge 38 of the card with connectors 74 mounted on the backplane 76 as shown in FIG. 2. Such an insertion/ejection member 320 is sold by Calmark, Inc.

Figure 12:
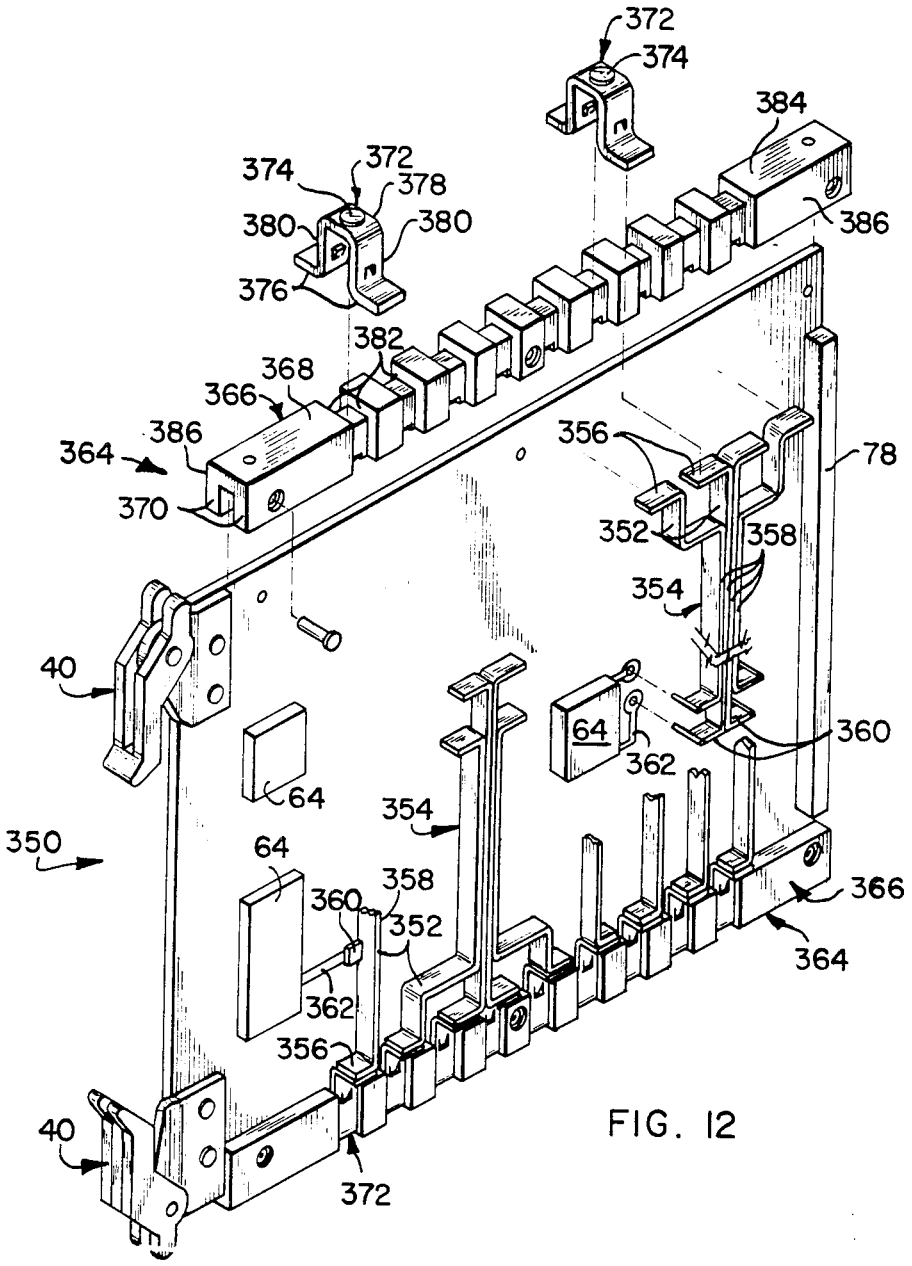
FIG. 12 is a perspective view of a second embodiment of the daughter card with which the present invention may be used, with one of the rail assemblies and a representative terminal exploded from an edge of the card and a power bus assembly exploded from a surface of the card.

A second embodiment of daughter card is shown in FIG. 12. Daughter card assembly 350 is usable with edge guide power connector 100, as is daughter card assembly 14 of FIG. 2. Daughter card assembly 350 is disclosed in U.S. patent application Ser. No. 121,246 filed Dec. 2, 1987 and assigned to the assignee hereof. In assembly 350, power current may be transmitted from each active edge to a component 64 by means of power bus members 352 which are preferably joined together into power bus assemblies 354 to preserve surface area of the circuit panel for mounting of components. Each power bus member 352 includes a first termination section 356 at the active edge, a body section 358, and a second termination section 360 in the interior of the major side surface 34,34' of the daughter card to be electrically connected to a power circuit path segment 362 respectively of the daughter card to which the component is also electrically connected.

The second termination section 360 of each power bus member may be either a tab portion which is surface mounted to a circuit path segment 362 of the daughter card such as by soldering, or may include a pin section inserted into and soldered within a plated through-hole of a power circuit path 362. Each power bus member may be coated with an insulative covering except at the termination sections such as with insulative varnish, and preferably are rigid bars of an appropriate conductive alloy. Such bus members have a conductive mass substantial enough to carry currents of levels of ten amperes or higher as desired, significantly higher than that carried by conventional etched circuit paths of circuit panels.

Power bus members are preferably elevated above the surface of the circuit panel by their termination sections, and they may also be insulated. As a result, they may pass over signal paths on the surface of the daughter card until they reach their intended termination point in the interior of the card, greatly enhancing the utilization of the card's valuable real estate for signal transmission, without resort to the use of multilayer daughter cards and the costly fabrication process involved therewith, just to provide for bussing of power current from the edge to the interior without interfering with signal circuit paths.

Along each active edge of the daughter card in FIG. 12 is a connector rail assembly 364 comprising a profiled dielectric rail member 366 having a body section 368 inwardly from which extend a pair of opposed pair of flanges 370 defining a card-receiving groove therebetween for mounting on the active edge of the card with the top (or bottom) side edge of the daughter card. A plurality of terminals 372 are contained in rail assembly 364, and each terminal 372 includes a contact section 374 such as a button of silver to be electrically engageable by a corresponding contact means of the edge guide power connector, and termination sections 376 electrically connected to first termination sections 356 of two respective power bus members 352 (one on each side of card 350), such as by soldering or welding, or optionally by using spring clips (not shown) of stainless steel which can be removed if desired for servicing and repair of the daughter card. Each terminal 372 has a top horizontal section 378 and two vertical sections 380 depending therefrom and disposed within recess 382 of rail member 366.

As with rail 32 of daughter card 14 of FIGS. 2 and 3, rail assembly 364 of FIG. 12 preferably has rectilinear outwardly facing top 384 and side 386 surfaces suitable to be bearing surfaces for insertion into the correspondingly shaped channel of the edge guide power connector. Being recessed below top surface 384 and side surfaces 386, terminals 372 do not interfere with insertion of daughter card assembly 350 into channels of the power connectors.

Variations to the linearly movably cammed edge guide power connector of the present invention may be devised which are within the spirit of the invention and the scope of the claims.

What is claimed is:

1. An electrical connector for distributing power current to a circuit panel along an active edge thereof, the connector having means for electrical connection to a plurality of power buses and at least one return path bus of the circuit panel, the connector being mountable to a frame opposed from cooperating card-receiving means of the frame, and the electrical connection means of the connector being electrically connectable to power conductor means or return path conductor means associated therewith, comprising:

housing means securable to the frame, said housing means including surfaces defining a channel open at one end into which an edge portion of a rigid panel is insertable longitudinally from said end thereof, a cam-receiving aperture parallel to said channel, and a plurality of terminal-receiving passageways each including at least a first portion in communication with said channel and further including a second portion in communication with said cam-receiving aperture;

a plurality of terminal members secured within respective said terminal-receiving passageways of said housing means associated with corresponding panel terminal means, each of said terminal members having a movable portion including a first contact section proximate said channel and disposed along a said channel-defining surface thereof for electrical engagement with a corresponding contact section of a said associated panel circuit path means exposed for such engagement upon mating, and further having a second contact section remote from said channel and electrically connectable to a corresponding contact means of an electrical power conductor means or a return path conductor means; and camming means secured within said cam-receiving aperture of said housing means, said camming means includes a cam shaft secured in said cam-receiving aperture of said housing means in a manner permitting linear movement therealong between an unactuated position and an actuated position, said camming means further including actuating means at an end of said housing means exposed for actuation;

said cam shaft including camming sections associated with respective said terminal members and engageable with cam-engaging sections of said terminal members through said second passageway portions upon actuation of said camming means, whereby said cam shaft upon actuation urges said movable terminal portions of said plurality of terminal members toward and into said channel from at least one said channel-defining surface to electrically engage corresponding contact sections of respective said panel circuit path means under appropriate contact normal force.

2. An electrical connector as set forth in claim 1 wherein said housing means includes a forward housing member, said forward housing member having along the bottom surface thereof a locking aperture adapted to receive thereinto corresponding securing means projecting from an end of a securing member pivotally mounted on the circuit panel when said circuit panel has been fully inserted into said channel and said securing member is pivoted to a securing position.

3. An electrical connector as set forth in claim 2 wherein said camming means further includes a rotary actuator secured in an actuator-receiving aperture of said forward housing member laterally offset from said cam-receiving aperture, said rotary actuator including a shaft portion in said actuator-receiving aperture in a manner permitting rotation therewithin between an actuated position and an unactuated position, said forward housing member including means for defining said actuated and unactuated positions in cooperation with said shaft portion of said rotary actuator, and said connector includes means connecting said rotary actuator and said cam shaft for moving said cam shaft linearly upon actuation and deactuation when said actuator is correspondingly rotated.

4. An electrical connector as set forth in claim 3 wherein said actuator includes a shaft portion having a helical groove segment defined by generally forwardly facing and rearwardly facing side wall surfaces, said cam moving means comprises a follower member held in a cavity of said cam shaft at a front end thereof and secured against lateral movement thereby, said follower member having a boss extending into said helical groove segment and movable relatively therealong upon rotary movement of said actuator, whereby upon rotation of said actuator, a respective one of said groove-defining side wall surfaces of said helical groove segment moves said follower linearly thus moving said cam shaft linearly.

5. An electrical connector as set forth in claim 1 wherein said cam shaft defines a bottom surface of said channel and including a plurality of angled vertical apertures in communication with said channel, each said terminal includes a cantilever portion depending from said mounting portion thereof and extending through a respective said angled aperture to a free end adjacent said channel and deflectable thereinto upon actuation of said cam shaft to electrically engage a corresponding contact means along a top surface of an active edge of a daughter card disposed within said channel, each said angled aperture including a first camming surface engageable with said cantilever portion upon linear actuation movement of said cam shaft to deflect said cantilever portion downwardly moving said free end thereof into said channel, and further including a second camming surface engageable with said cantilever portion upon linear movement of said cam shaft during deactuation to deflect said cantilever portion upwardly moving said free end thereof away from said daughter card active edge and out of said channel.

6. An electrical connector as set forth in claim 5 wherein said free end has an arcuate shape and said angled aperture of said cam shaft includes a recessed area, said arcuate free end being movable thereinto when said cantilever portion of said terminal is deflected away from said channel.

7. An electrical connector as set forth in claim 5 wherein said cantilever portion of each said terminal extends downwardly and forwardly at an angle from a front edge of a horizontal section of said terminal, said first camming surface is disposed on a rearwardly facing surface of a respective said aperture, and said second camming surface is disposed on a forwardly facing surface thereof.

8. An electrical connector as set forth in claim 7 wherein said housing means includes a middle dielectric member disposed between said cam shaft and an upper housing means and having a plurality of angled apertures associated with respective said terminals and generally aligned with said angled apertures of said cam shaft, and said horizontal sections of said terminals extend along top surface portions of said middle member with said angled cantilever portions extending through respective said apertures thereof and into said angled apertures of said cam shaft.

9. An electrical connector as set forth in claim 5 wherein said housing means includes an upper housing member having opposed flanges extending downwardly from a body section and defining said cam-receiving aperture, inner surfaces of said flanges include opposed first rail receiving channels, opposed outwardly facing side surfaces of said cam shaft include second rail receiving channels opposed from and paired with respective said first rail receiving channels, and retention rail members are inserted in said paired rail receiving channels holding said cam shaft to said upper housing member and adapted to permit linear movement of said cam shaft with respect to said upper housing member, ends of said retention rails being held in forward and rearward housing members secured to said upper housing member.

* * * * *